US007685787B1

(12) United States Patent
Mollinger et al.

(10) Patent No.: US 7,685,787 B1
(45) Date of Patent: Mar. 30, 2010

(54) SYSTEM AND METHOD FOR LEVELING OR ALIGNMENT OF PANELS

(75) Inventors: Paul J. Mollinger, Blacklick, OH (US); Paul R. Pelfrey, Wheelersburg, OH (US); Larry R. Fairbanks, Columbus, OH (US)

(73) Assignee: Crane Building Products LLC, Columbus, OH (US)

( * ) Notice: Subject to any disclaimer, the term of this patent is extended or adjusted under 35 U.S.C. 154(b) by 282 days.

(21) Appl. No.: 11/617,704

(22) Filed: Dec. 28, 2006

Related U.S. Application Data

(60) Provisional application No. 60/754,376, filed on Dec. 28, 2005.

(51) Int. Cl.
*E04B 1/00* (2006.01)

(52) U.S. Cl. ..... 52/547; 52/543; 52/550; 52/551; 52/557; 52/459; 52/461; 52/462; 52/464; 52/468

(58) Field of Classification Search ..... 52/546–548, 52/459, 461–462, 468–470, 543–544, 550, 52/551, 556, 464
See application file for complete search history.

(56) References Cited

U.S. PATENT DOCUMENTS

| | | | | |
|---|---|---|---|---|
| 476,381 | A * | 6/1892 | Hawthorne | 52/276 |
| 1,446,455 | A * | 2/1923 | Fischer | 52/395 |
| 1,463,482 | A * | 7/1923 | Mountford | 52/547 |
| 1,477,167 | A * | 12/1923 | Fischer | 52/547 |
| 1,589,675 | A | 6/1926 | Belding | |
| 1,728,934 | A | 9/1929 | Hogenson | |
| 2,188,090 | A * | 1/1940 | Young | 52/459 |
| 2,495,303 | A * | 1/1950 | Wisniewski | 52/468 |
| 2,730,969 | A * | 1/1956 | Perry | 52/276 |
| 2,830,546 | A | 4/1958 | Rippe | |
| D196,230 | S | 9/1963 | Raftery et al. | |
| 3,159,943 | A | 12/1964 | Sugar et al. | |
| 3,233,382 | A | 2/1966 | Graveley, Jr. | |
| 3,246,436 | A | 4/1966 | Roush | |
| 3,289,365 | A | 12/1966 | McLaughlin et al. | |
| 3,289,380 | A | 12/1966 | Charniga, Jr. | |
| 3,325,952 | A | 6/1967 | Trachtenberg | |

(Continued)

FOREIGN PATENT DOCUMENTS

| | | |
|---|---|---|
| CA | 96829 | 8/2002 |

(Continued)

OTHER PUBLICATIONS

Sweet's General Building & Renovation, 1995 Catalog File; section 07460 on Siding, pp. 4-20.

(Continued)

*Primary Examiner*—Jeanette Chapman
(74) *Attorney, Agent, or Firm*—Standley Law Group LLP

(57) ABSTRACT

A system for connecting and sealing panels comprising a bridge component with elevated and recessed surface features adapted to receive and bridge adjacent panels to form a weather-resistant seal and aesthetically pleasing appearance. By providing mating surface features to receive a side edge portion of an adjacent panel assembly, an exemplary embodiment of the present invention may enable an improved lap joint to be established between adjacent backed panels.

11 Claims, 7 Drawing Sheets

U.S. PATENT DOCUMENTS

| | | | | | |
|---|---|---|---|---|---|
| 3,327,446 | A | * | 6/1967 | Tracy | 52/547 |
| 3,332,711 | A | * | 7/1967 | Holly | 52/468 |
| D208,251 | S | | 8/1967 | Facer | |
| 3,387,418 | A | | 6/1968 | Tyrer | |
| 3,399,916 | A | | 9/1968 | Ensor | |
| 3,473,274 | A | | 10/1969 | Godes | |
| 3,520,099 | A | | 7/1970 | Mattes | |
| 3,552,078 | A | | 1/1971 | Mattes | |
| 3,555,762 | A | | 1/1971 | Costanzo, Jr. | |
| 3,637,459 | A | | 1/1972 | Parish et al. | |
| 3,703,795 | A | | 11/1972 | Mattes | |
| 3,815,310 | A | | 6/1974 | Kessler | |
| 3,826,054 | A | | 7/1974 | Culpepper, Jr. | |
| 3,861,326 | A | * | 1/1975 | Brown | 108/57.29 |
| 3,969,866 | A | | 7/1976 | Kyne | |
| 3,970,502 | A | | 7/1976 | Turner | |
| 4,001,997 | A | | 1/1977 | Saltzman | |
| 4,033,802 | A | | 7/1977 | Culpepper, Jr. et al. | |
| 4,034,528 | A | | 7/1977 | Sanders et al. | |
| 4,048,101 | A | | 9/1977 | Nakamachi et al. | |
| 4,081,939 | A | | 4/1978 | Culpepper, Jr. et al. | |
| 4,096,011 | A | | 6/1978 | Sanders et al. | |
| 4,102,106 | A | | 7/1978 | Golder et al. | |
| 4,104,841 | A | | 8/1978 | Naz | |
| 4,118,166 | A | | 10/1978 | Bartrum | |
| 4,188,762 | A | | 2/1980 | Tellman | |
| 4,189,885 | A | | 2/1980 | Fritz | |
| 4,272,576 | A | | 6/1981 | Britson | |
| 4,279,106 | A | | 7/1981 | Gleason et al. | |
| 4,319,439 | A | | 3/1982 | Gussow | |
| 4,320,613 | A | | 3/1982 | Kaufman | |
| 4,327,528 | A | | 5/1982 | Fritz | |
| 4,352,771 | A | | 10/1982 | Szabo | |
| 4,389,824 | A | | 6/1983 | Anderson | |
| 4,424,655 | A | | 1/1984 | Trostle | |
| 4,429,503 | A | | 2/1984 | Holliday | |
| 4,450,665 | A | | 5/1984 | Katz | |
| D274,947 | S | | 7/1984 | Culpepper, Jr. et al. | |
| 4,492,064 | A | | 1/1985 | Bynoe | |
| 4,506,486 | A | | 3/1985 | Culpepper, Jr. et al. | |
| 4,593,512 | A | | 6/1986 | Funaki | |
| 4,608,800 | A | | 9/1986 | Fredette | |
| 4,646,501 | A | * | 3/1987 | Champagne et al. | 52/520 |
| 4,649,008 | A | | 3/1987 | Johnstone et al. | |
| 4,680,911 | A | | 7/1987 | Davis et al. | |
| D291,249 | S | | 8/1987 | Manning | |
| 4,694,628 | A | | 9/1987 | Vondergoltz et al. | |
| 4,709,519 | A | | 12/1987 | Liefer et al. | |
| 4,716,645 | A | | 1/1988 | Pittman et al. | |
| 4,782,638 | A | | 11/1988 | Hovind | |
| 4,814,413 | A | | 3/1989 | Thibaut et al. | |
| 4,843,790 | A | | 7/1989 | Taravella | |
| 4,856,975 | A | | 8/1989 | Gearhart | |
| 4,864,788 | A | | 9/1989 | Tippmann | |
| 4,911,628 | A | | 3/1990 | Heilmayr et al. | |
| 4,920,709 | A | | 5/1990 | Garries et al. | |
| 4,930,287 | A | | 6/1990 | Volk et al. | |
| 4,962,622 | A | | 10/1990 | Albrecht et al. | |
| 4,969,302 | A | | 11/1990 | Coggan et al. | |
| D316,299 | S | | 4/1991 | Hurlburt | |
| 5,016,415 | A | | 5/1991 | Kellis | |
| 5,022,204 | A | | 6/1991 | Anderson | |
| 5,022,207 | A | | 6/1991 | Hartnett | |
| 5,024,045 | A | | 6/1991 | Fluent et al. | |
| 5,050,357 | A | | 9/1991 | Lawson | |
| 5,080,950 | A | | 1/1992 | Burke | |
| 5,090,174 | A | | 2/1992 | Fragale | |
| 5,103,612 | A | | 4/1992 | Wright | |
| 5,224,315 | A | | 7/1993 | Winter, IV | |
| 5,230,377 | A | | 7/1993 | Berman | |
| D342,579 | S | | 12/1993 | Mason | |
| 5,282,344 | A | | 2/1994 | Moore | |
| 5,303,525 | A | | 4/1994 | Magee | |
| 5,306,548 | A | | 4/1994 | Zabrocki et al. | |
| 5,318,737 | A | | 6/1994 | Trabert et al. | |
| 5,347,784 | A | | 9/1994 | Crick et al. | |
| 5,363,623 | A | | 11/1994 | King | |
| 5,387,381 | A | | 2/1995 | Saloom | |
| 5,415,921 | A | | 5/1995 | Grohman | |
| D361,138 | S | | 8/1995 | Moore et al. | |
| 5,443,878 | A | | 8/1995 | Treloar et al. | |
| 5,461,839 | A | | 10/1995 | Beck | |
| 5,465,486 | A | | 11/1995 | King | |
| 5,465,543 | A | | 11/1995 | Seifert | |
| 5,475,963 | A | | 12/1995 | Chelednik | |
| 5,482,667 | A | | 1/1996 | Dunton et al. | |
| 5,502,940 | A | | 4/1996 | Fifield | |
| 5,537,791 | A | | 7/1996 | Champagne | |
| 5,542,222 | A | | 8/1996 | Wilson et al. | |
| 5,548,940 | A | | 8/1996 | Baldock | |
| 5,551,204 | A | | 9/1996 | Mayrand | |
| 5,560,170 | A | | 10/1996 | Ganser et al. | |
| 5,564,246 | A | | 10/1996 | Champagne | |
| 5,565,056 | A | | 10/1996 | Lause et al. | |
| 5,575,127 | A | | 11/1996 | O'Neal | |
| 5,581,970 | A | | 12/1996 | O'Shea | |
| 5,586,415 | A | | 12/1996 | Fisher et al. | |
| 5,598,677 | A | | 2/1997 | Rehm, III | |
| 5,613,337 | A | | 3/1997 | Plath et al. | |
| 5,622,020 | A | | 4/1997 | Wood | |
| 5,634,314 | A | | 6/1997 | Champagne | |
| 5,651,227 | A | | 7/1997 | Anderson | |
| 5,661,939 | A | | 9/1997 | Coulis et al. | |
| 5,662,977 | A | | 9/1997 | Spain et al. | |
| 5,664,376 | A | | 9/1997 | Wilson et al. | |
| 5,675,955 | A | | 10/1997 | Champagne | |
| 5,678,367 | A | | 10/1997 | Kline | |
| 5,694,728 | A | | 12/1997 | Heath, Jr. et al. | |
| 5,720,114 | A | | 2/1998 | Guerin | |
| 5,729,946 | A | | 3/1998 | Beck | |
| 5,737,881 | A | | 4/1998 | Stocksieker | |
| 5,765,333 | A | | 6/1998 | Cunningham | |
| 5,768,844 | A | | 6/1998 | Grace, Sr. et al. | |
| 5,791,093 | A | | 8/1998 | Diamond | |
| 5,806,185 | A | | 9/1998 | King | |
| 5,809,731 | A | | 9/1998 | Reiss | |
| 5,829,206 | A | | 11/1998 | Bachman | |
| 5,836,113 | A | | 11/1998 | Bachman | |
| D402,770 | S | | 12/1998 | Hendrickson et al. | |
| 5,857,303 | A | | 1/1999 | Beck et al. | |
| 5,858,522 | A | | 1/1999 | Turk et al. | |
| 5,866,054 | A | | 2/1999 | Dorchester et al. | |
| 5,866,639 | A | | 2/1999 | Dorchester et al. | |
| 5,869,176 | A | | 2/1999 | Dorchester et al. | |
| 5,878,543 | A | | 3/1999 | Mowery | |
| 5,946,876 | A | | 9/1999 | Grace, Sr. et al. | |
| 5,956,914 | A | | 9/1999 | Williamson | |
| 5,974,756 | A | | 11/1999 | Alvarez et al. | |
| 6,029,415 | A | | 2/2000 | Culpepper et al. | |
| 6,035,587 | A | | 3/2000 | Dressler | |
| 6,047,507 | A | | 4/2000 | Lappin et al. | |
| 6,050,041 | A | | 4/2000 | Mowery et al. | |
| 6,086,997 | A | | 7/2000 | Patel et al. | |
| D429,009 | S | | 8/2000 | Ginzel | |
| 6,122,877 | A | | 9/2000 | Hendrickson et al. | |
| 6,161,354 | A | | 12/2000 | Gilbert et al. | |
| 6,187,424 | B1 | | 2/2001 | Kjellqvist et al. | |
| 6,195,952 | B1 | | 3/2001 | Culpepper et al. | |
| 6,223,488 | B1 | | 5/2001 | Pelfrey et al. | |
| 6,233,890 | B1 | | 5/2001 | Tonyan | |
| 6,263,574 | B1 | | 7/2001 | Lubker, II et al. | |
| 6,272,797 | B1 | | 8/2001 | Finger | |
| D447,820 | S | | 9/2001 | Grace | |
| 6,282,858 | B1 | | 9/2001 | Swick | |

| | | | |
|---|---|---|---|
| D448,865 | S | 10/2001 | Manning |
| 6,295,777 | B1 | 10/2001 | Hunter et al. |
| D450,138 | S | 11/2001 | Barber |
| 6,321,500 | B1 | 11/2001 | Manning et al. |
| 6,336,988 | B1 | 1/2002 | Enlow et al. |
| 6,348,512 | B1 | 2/2002 | Adriani |
| D454,962 | S | 3/2002 | Grace |
| 6,358,585 | B1 | 3/2002 | Wolff |
| 6,360,508 | B1 | 3/2002 | Pelfrey et al. |
| 6,363,676 | B1 | 4/2002 | Martion, III |
| 6,367,220 | B1 | 4/2002 | Krause et al. |
| 6,393,792 | B1 | 5/2002 | Mowery et al. |
| 6,442,912 | B1 | 9/2002 | Phillips et al. |
| 6,516,577 | B2 | 2/2003 | Pelfrey et al. |
| D471,292 | S | 3/2003 | Barber |
| 6,526,718 | B2 | 3/2003 | Manning et al. |
| 6,539,675 | B1 | 4/2003 | Gile |
| 6,594,965 | B2 | 7/2003 | Coulton |
| 6,625,939 | B1 | 9/2003 | Beck et al. |
| D481,804 | S | 11/2003 | Pelfrey |
| 6,673,868 | B2 | 1/2004 | Choulet |
| 6,716,522 | B2 | 4/2004 | Matsumoto et al. |
| 6,752,941 | B2 | 6/2004 | Hills |
| 6,784,230 | B1 | 8/2004 | Patterson et al. |
| 6,865,849 | B1 | 3/2005 | Mollinger et al. |
| 6,886,301 | B2 | 5/2005 | Schilger |
| 6,988,345 | B1 | 1/2006 | Pelfrey et al. |
| 2001/0041256 | A1 | 11/2001 | Heilmayr |
| 2002/0018907 | A1 | 2/2002 | Zehner |
| 2002/0020125 | A1 | 2/2002 | Pelfrey et al. |
| 2002/0025420 | A1 | 2/2002 | Wanat et al. |
| 2002/0029537 | A1 | 3/2002 | Manning et al. |
| 2002/0054996 | A1 | 5/2002 | Rheenen |
| 2002/0056244 | A1 | 5/2002 | Hertweck |
| 2002/0076544 | A1 | 6/2002 | DeWorth et al. |
| 2002/0078650 | A1 | 6/2002 | Bullinger et al. |
| 2002/0090471 | A1 | 7/2002 | Burger et al. |
| 2002/0108327 | A1 | 8/2002 | Shaw |
| 2002/0177658 | A1 | 11/2002 | Tajima et al. |
| 2003/0014936 | A1 | 1/2003 | Watanabe |
| 2003/0056458 | A1 | 3/2003 | Black et al. |
| 2003/0131551 | A1 | 7/2003 | Mollinger et al. |
| 2003/0154664 | A1 | 8/2003 | Beck et al. |
| 2004/0003566 | A1 | 1/2004 | Sicuranza |
| 2004/0026021 | A1 | 2/2004 | Groh et al. |
| 2004/0142157 | A1 | 7/2004 | Melkonian |
| 2004/0211141 | A1 | 10/2004 | Sandy |
| 2005/0081468 | A1 | 4/2005 | Wilson et al. |
| 2006/0026920 | A1 | 2/2006 | Fairbanks et al. |
| 2006/0053740 | A1 | 3/2006 | Wilson et al. |

FOREIGN PATENT DOCUMENTS

| | | | |
|---|---|---|---|
| CA | 2267000 | | 4/2003 |
| CL | 3.856 | | 5/2001 |
| DE | 40104760.1 | | 5/2001 |
| EP | 1086988 | A1 | 3/2001 |
| GB | 1068202 | | 5/1967 |
| GB | 2101944 | | 8/2001 |
| JP | 364001539 | A | 1/1989 |
| JP | 409141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | WO 00/55446 | A1 | 9/2000 |

OTHER PUBLICATIONS

Web site print outs from www.dupontdow.com, "Adhesives," Aug. 12, 2000, 3 pages.

Web site print outs from www.dupontdow.com, "Neoprene—Grades of Neoprene—AquaStikTM Water Based Polychloroprene." Aug. 12, 2000, 2 pages.

Web site print outs from www.dupontdow.com, "Neoprene—Grades of Neoprene—Neoprene Solid Grades for Solvent-Based Adhesives." Aug. 12, 2000, 2 pages.

"New Craneboard solid core siding redefines home exterior siding," Crane Performance Siding news release online, Mar. 20, 2001, 3 pages.

Jim Weiker, "Crane puts new face on siding," The Columbus Dispatch, May 9, 2002, 3 pages.

Innovations for Living, "What Do I Look For in Quality Vinyl Siding?" Owens Corning, Nov. 9, 2002, 1 page.

Crane in the News, International Builders' Show Preview, Jan./Feb. 2003, 1 page.

Mark Feirer, "Vinyl Siding, Love it or hate it, plastic is here to stay," This Old House Online, no date, 8 pages.

* cited by examiner

SYSTEM AND METHOD FOR LEVELING OR ALIGNMENT OF PANELS

This application claims the benefit of U.S. Provisional Application No. 60/754,376, filed Dec. 28, 2005, which is hereby incorporated by reference in its entirety.

BACKGROUND AND SUMMARY OF THE INVENTION

Some exemplary embodiments of the present invention relate generally to panels and, more particularly, to a backed panel and a backed panel assembly. Some exemplary embodiments of the present invention may also relate generally to components and methods for connecting panels. Examples of panels that may benefit include siding panels, wall panels, and other similar or suitable types of panels or components. U.S. Pat. No. 6,321,500 is hereby incorporated by reference as just one example of a panel that may benefit. Although the exemplary embodiments of the present invention may be described herein primarily with regard to siding panels and wall panels, it is not intended to limit the present invention to any particular type of panel, component, assembly, or method, unless expressly claimed otherwise. Examples of the types of siding panels that may benefit include, but are not limited to, metal siding, vinyl siding, fiber cement siding, plastic composite siding, and wood siding, either singly or using any number of possible panel backing materials known in the art, such as fiberglass, expanded polystyrene, other foamed plastics, or any other similar or suitable backing material.

In order to enhance the thermal insulation of building structures, one or more layers or panels of insulating material may be provided between a facing panel and a building structure. Known insulated siding systems exist in many different forms. A common problem with known insulated siding systems is the joint between the sides of adjacent siding units. Simply abutting siding units that are situated side-by-side may leave an unsightly gap that may be infiltrated by wind, rain, and insects. On the other hand, overlapping the siding panels of adjacent backed siding units may result in an uneven or raised seam. A raised or uneven seam may also detract from the appearance of the siding and create a passage for the undesired transfer of air, moisture, and insects. In addition, a raised or uneven seam may increase the risk of oil canning of the siding panels as well as delamination of the siding units. Furthermore, overlapping the siding panels may cause breakage or other damage to the underlying backing panel, which compromises the functionality of the backing panel. Thus, to achieve the desired level of integration between adjacent backed paneling units, an improved system and method of forming and optionally sealing a joint between backed panels is needed.

In one exemplary embodiment, a system is provided for connecting panels, wherein a bridge component may be used to align, level, seal, or otherwise connect adjacent panels. The bridge component may optionally be adapted to interlock with mating features of a facing panel, a backing panel, or both. By using a bridge component to connect adjacent panels, an exemplary embodiment of the present invention may enable an improved lap joint to be established between adjacent panels.

Another exemplary embodiment of the present invention may incorporate a protuberant surface feature, such as a bead-line, that may provide a sealing surface between the edge surfaces of adjacent panels. An exemplary embodiment of a bead-line may comprise, but is not limited to, flexible polymers or elastomers and may be designed such that its projected height forms an essentially flush surface with the adjacent panel surfaces to form a pleasing appearance. Yet another example of an embodiment of the present invention may comprise a grooved or recessed surface feature that may provide a foundation for a filler material, such as a flexible plastic (e.g., polyurethane) or any other similar or suitable filler material. For example, a filler material may be applied within a gap formed between adjacent panel edges to ultimately produce a surface that may be flush with the adjacent panel faces, thereby hiding the joint, providing a weather resistant seal, and/or producing an aesthetically pleasing appearance.

In addition to the novel features and advantages mentioned above, other features and advantages will be readily apparent from the following descriptions of the drawings and exemplary embodiments.

DETAILED DESCRIPTION OF EXEMPLARY EMBODIMENT(S)

Some exemplary embodiments of the present invention relate to a component, system, assembly, and method for leveling, aligning, sealing, or otherwise connecting panels. In order to eliminate the aforementioned undesirable characteristics of a lap or butt type joint, some exemplary embodiments of this invention address a novel system and method to level and align as well as seal adjacent panels in an aesthetically pleasing manner.

Figure 1A:
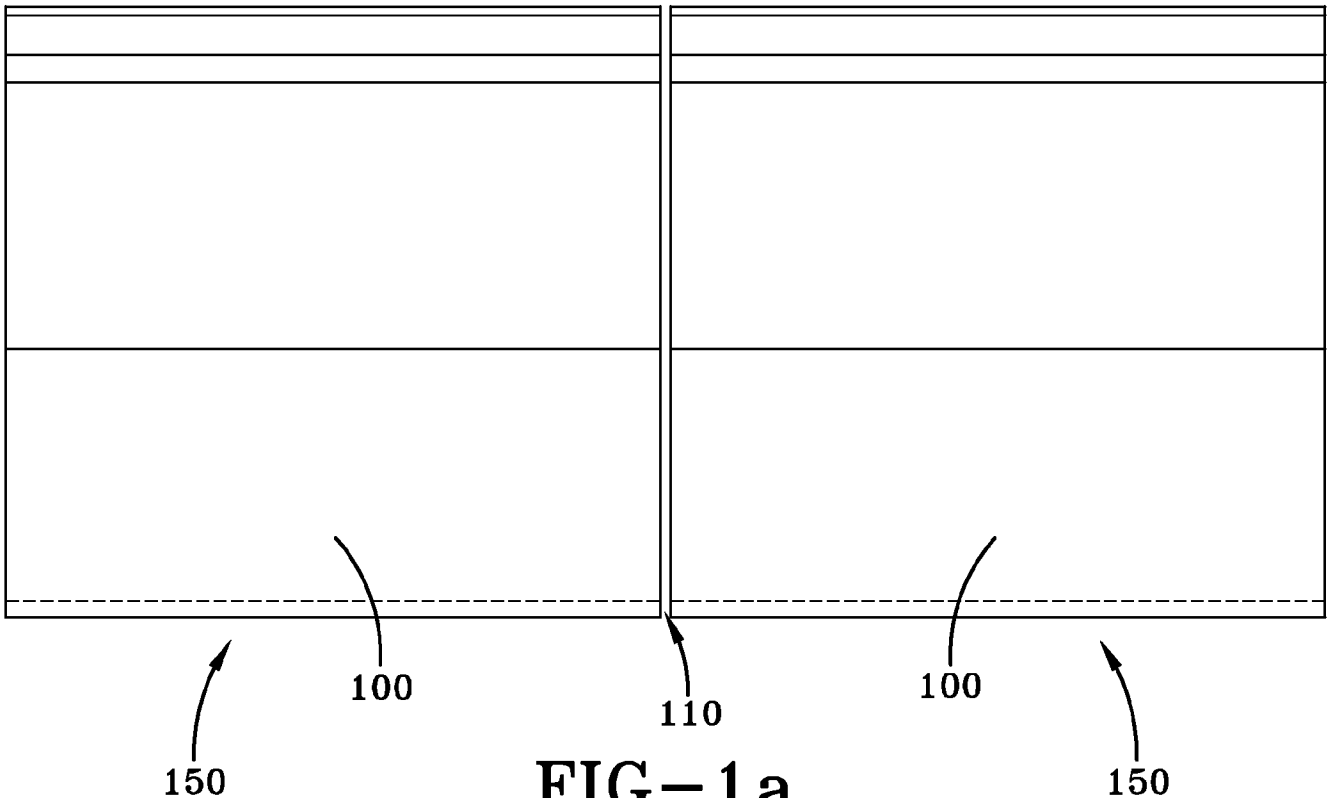
FIG. 1*a* is a front elevation view illustrating one example of a joint between adjacent panels.
Figure 1B:
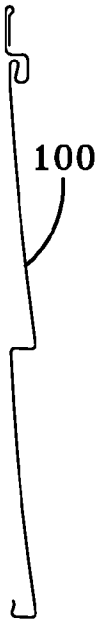
FIG. 1*b* is a side elevation view illustrating one example of a facing panel.
Figure 2:
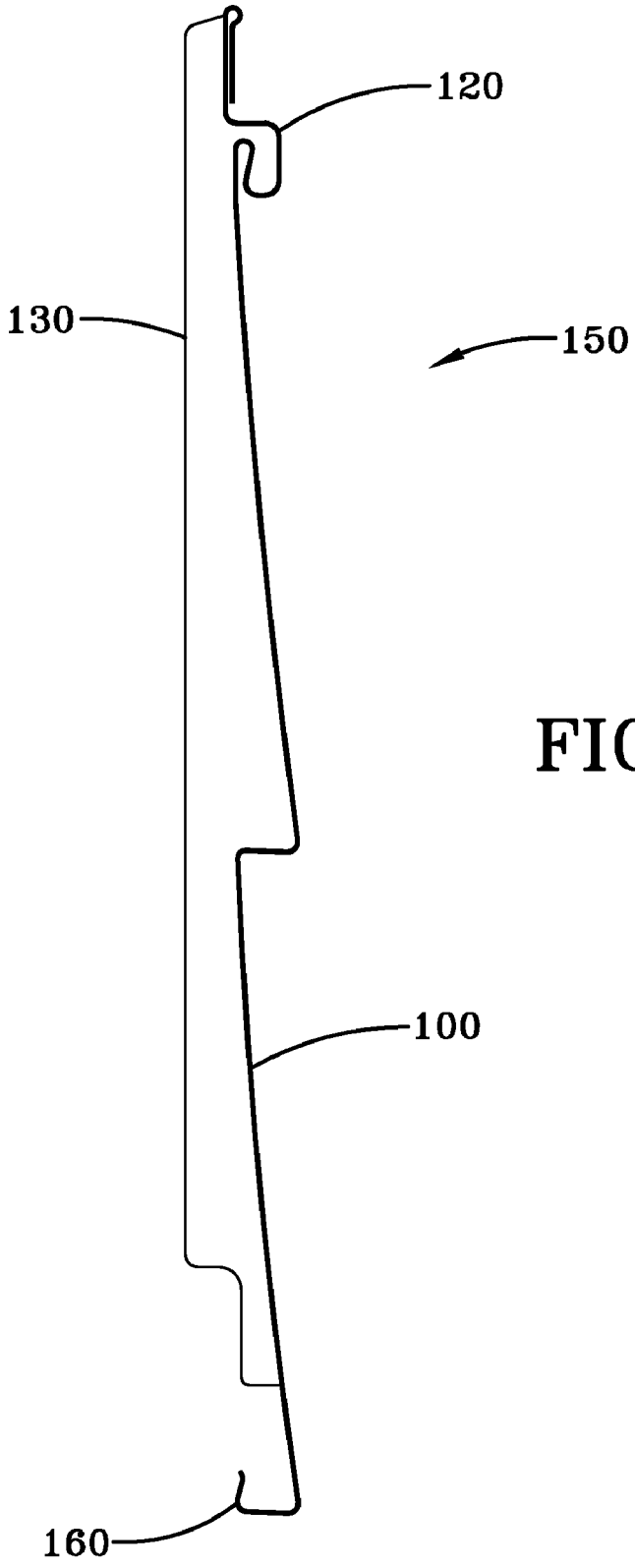
FIG. 2 is a side elevation view of one example of a backed panel.

FIG. 1*a* illustrates an example of one configuration of assembled panels such as those used in the installation of residential siding. In the figure, panel assemblies 150 are positioned in an adjacent fashion in horizontal rows with vertical joints 110 formed between the panels. FIG. 1*b* shows a side elevation view of a face panel 100 of a panel assembly 150. FIG. 2 shows another view of a panel assembly 150. Such as in this example, panel assembly 150 may include a lip or tongue feature 120 and a lip or groove feature 160, which may optionally facilitate interconnection with other similar or suitable panel assemblies. For example, similar panel assemblies may be connected together to effectively cover a surface, such as the exterior wall of a residential or commercial structure (e.g., a home). It should be recognized that other panel assemblies may also benefit from exemplary embodiments of the present invention.

Backed siding panels, such as those used in residential siding applications, may be comprised of two components, namely a face panel 100 and a backing panel 130. The face panel 100 may be manufactured from any material suitable for such a purpose, which may include, but is not limited to, fiber cement, wood, or a plastic or polymer such as a vinyl material. Other materials such as polypropylene, polyethylene, other plastics and polymers, polymer composites (such as polymer reinforced with fibers or other particles of glass, graphite, wood, flax, other cellulosic materials, or other inorganic or organic filler materials), metals (such as aluminum or polymer coated metal), or other similar or suitable materials may also be used.

The backing panel 130 may be used for panel joint stiffness, reinforcement, stability, thermal insulation, sound deadening, weatherproofing, or reduction of oil canning, for example. Backing panel 130 may be comprised of any suitable material. For example, backing panel 130 may be comprised of a foamed plastic (e.g., expanded or extruded polystyrene foam, polyurethane foam, or any other desired plastic foam material) or any other similar or suitable reinforcing or insulating material. In fact, it should be recognized that backing panel 130 may be comprised of any material having desired physical characteristics including, but not limited to, foam, fiberglass, cardboard, and other similar or suitable materials.

Figure 7A:
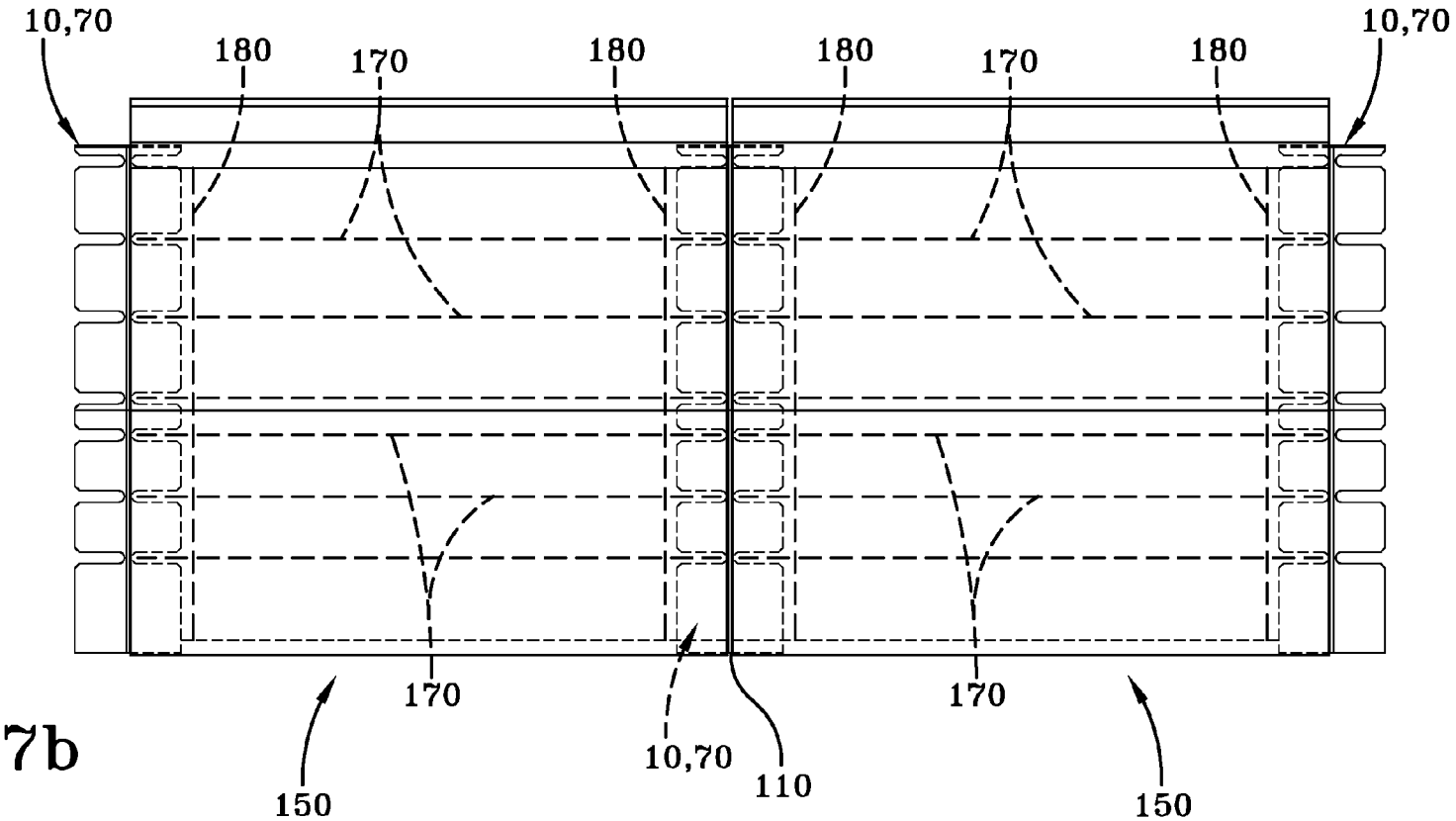
FIGS. 7*a* and 7*b* are orthogonal views of one exemplary embodiment of an assembly of adjacent panels.

Attachment of the backing panel 130 to the face panel 100 may be achieved using any suitable means of attachment known to those familiar in the art. Examples of attachment methods include, but are not limited to, adhesives, glues, epoxies, polymers, tapes (pressure sensitive adhesive tapes), as well as other methods that may include mechanical means such as fasteners, VELCRO™, other hook and loop fastening materials, or other methods. For example, as shown in FIG. 7*a*, beads of adhesive 170 in uniform rows between the backing panel 130 and face panel 100 may be used to bond a portion of backing panel 130 to a portion of the interior surface of face panel 100. Other variations are also possible. In one exemplary embodiment, the attachment material may be flexible such that it may help to compensate for the expansion and contraction forces between backing panel 130 and face panel 100, which may expand and contract at different rates.

Figure 3:
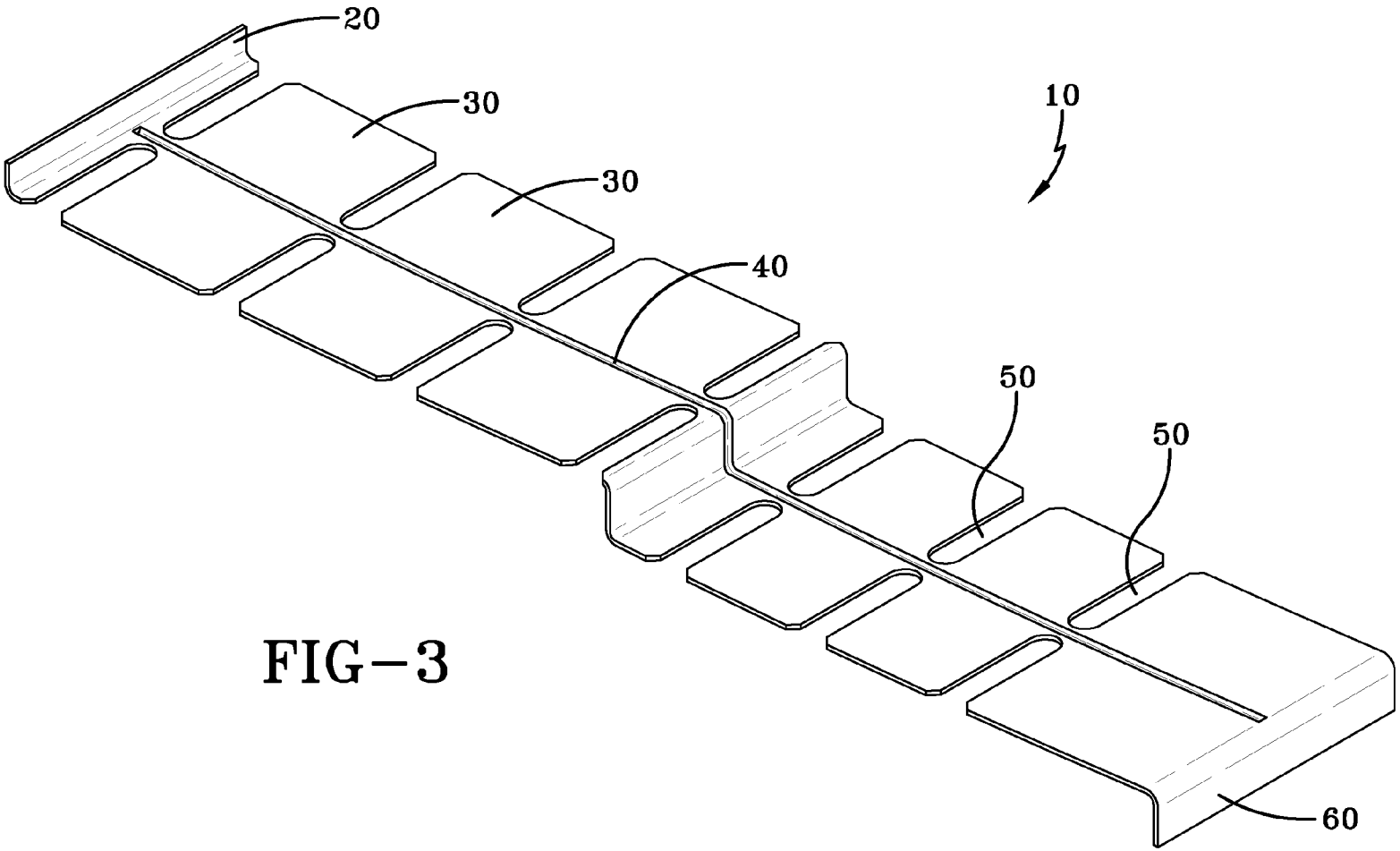
FIG. 3 is a perspective view of one exemplary embodiment of a bridge component of the present invention.
Figure 7B:
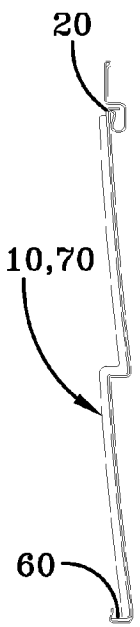

FIG. 3 illustrates an exemplary embodiment of a bridge component 10 having a web structure that may be generally configured to match the side elevation profiles of adjoining or adjacent face panels such as shown in FIG. 7*b*. Note that FIGS. 1*b* and 7*b* are just two examples of a panel cross-sectional shape and that any other panel cross-section may benefit from exemplary embodiments of the invention. Upper lip 20 and lower lip 60 features may be embodied on the distal ends of said web structure of the bridge component 10 to effectively enhance engagement with said face panel 100 and/or backing panel 130 by matching cross-sectional contours between components. It should be noted that upper lip 20 and lower lip 60 features may be optional as desired or as needed in particular panel cross-sections. A single tab or plurality of tabs 30 provide surfaces upon which to engage said panels 100 and 130 as described in further detail below. In addition, a single slot or plurality of slots 50 may be optionally embodied to accommodate and provide relief for adhesive bead-lines 170 used to join backing panel 130 and face panel 100 during the manufacture of a panel assembly 150. In this particular exemplary embodiment of the invention, a grooved or recessed surface feature 40 may, for example, be embodied on or near the longitudinal centerline and upper surface of the device. When bridge component 10 is installed between adjacent panels as shown in FIGS. 7*a* and 7*b*, groove 40 may be positioned directly beneath joint 110 to receive a subsequently applied filler material such as a flexible polymer or polyurethane that is subsequently applied within a gap formed between adjacent panel edges to ultimately produce a surface flush with the adjacent joined panel faces, thereby hiding the joint, providing a weather-resistant seal, and producing an aesthetically pleasing appearance.

Figure 4:
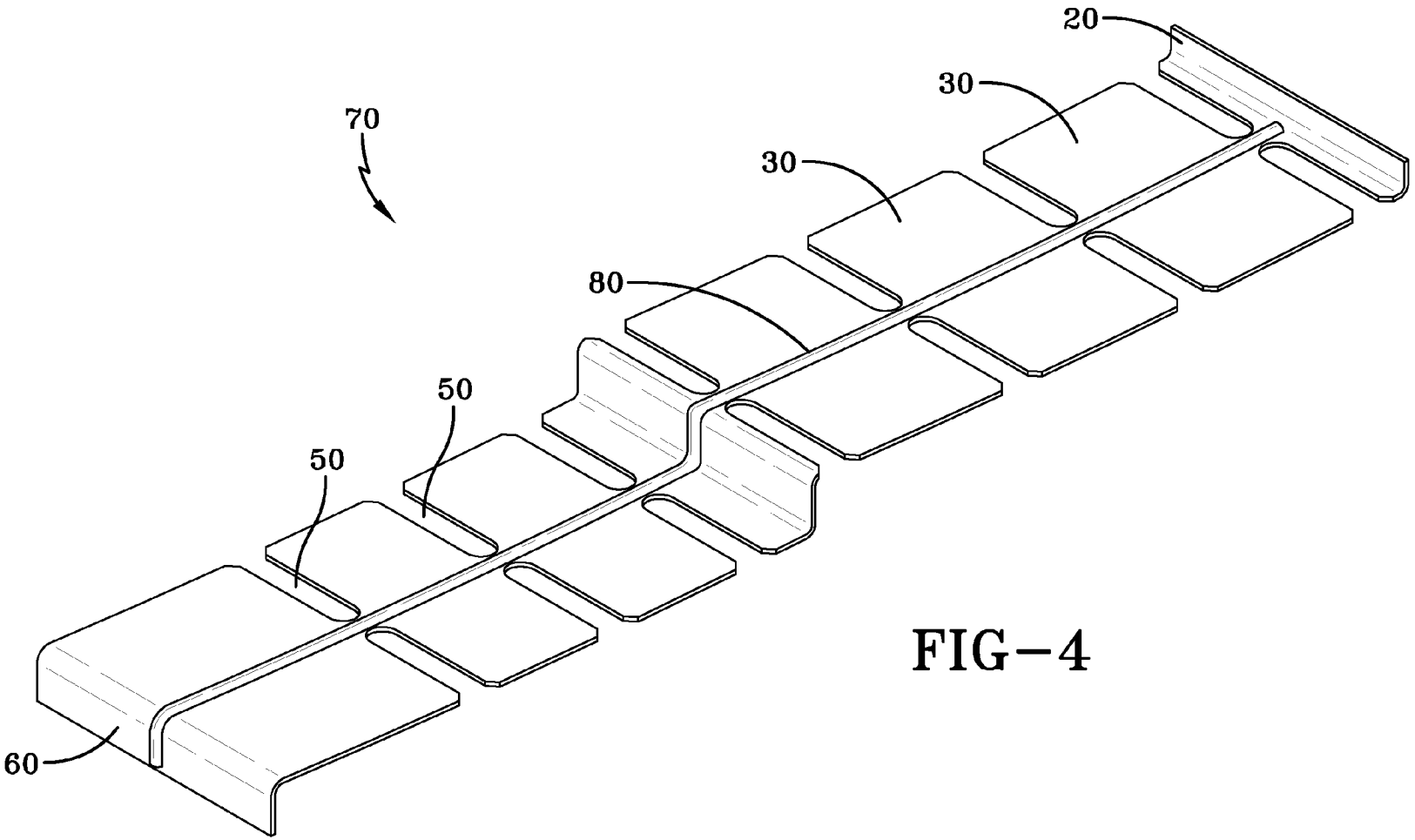
FIG. 4 is a perspective view of one exemplary embodiment of a bridge component of the present invention.

FIG. 4 illustrates yet another exemplary embodiment of the present invention that comprises a bridge component 70 having a web structure that may be configured to similarly match the side elevation profiles of adjoining or adjacent panels such as shown in FIG. 7*b*. A protuberant bead-line 80 of material may be similarly embodied on or near the longitudinal centerline and upper surface of bridge component 70 such that during installation bead-line 80 may be positioned directly beneath joint 110 formed between adjacently positioned panels 150 to form a weatherproof seal and pleasing appearance. Bead-line 80 may provide a sealing surface between the edge surfaces of adjacently mounted panels. Bead-line 80 may comprise, but is not limited to, flexible polymers, elastomers, or other similar or suitable materials and may be designed such that its projected height forms an essentially flush surface with the adjacent exterior panel surfaces to form a pleasing appearance.

A bridge component 10 or 70 and other variants thereof may be manufactured from any material suitable for such a purpose, which may include, but is not limited to, fiber cement, wood, or a polymer such as a vinyl material. Other materials such as polypropylene, polyethylene, other plastics and polymers, polymer composites (such as polymer reinforced with fibers or other particles of glass, graphite, wood, flax, other cellulosic materials, or other inorganic or organic filler materials), metals (such as aluminum or polymer coated metal), or other similar or suitable materials may also be used. Exemplary embodiments of the invention may be molded, extruded, or formed by any other suitable manufacturing technique or combination of techniques known in the art.

Figure 5:
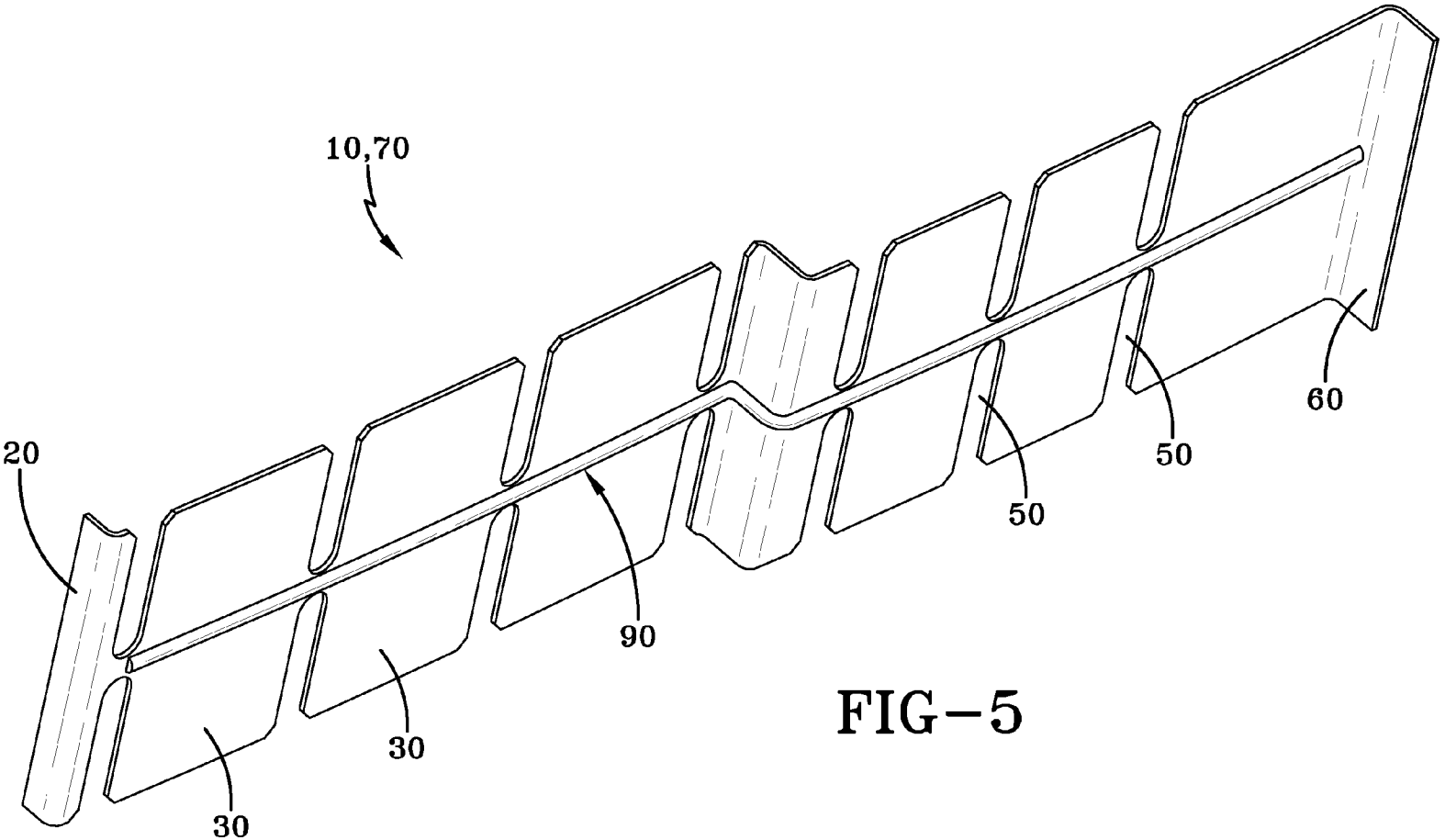
FIG. 5 is a perspective view of an underside of one exemplary embodiment of a bridge component of the present invention.

FIG. 5 illustrates one example of a support gusset or protuberant member 90 that may be embodied on a rear surface of either bridge component 10 or 70 beneath the groove 40 or protuberant bead-line 80, respectively, to provide structural integrity to the device and resulting panel assembly. A protuberant member 90 may be fabricated by any suitable means known in the art, such as, but not limited to, injection molding, compression molding, or extrusion and forming, depending on the materials used and the particular application.

Figure 6A:
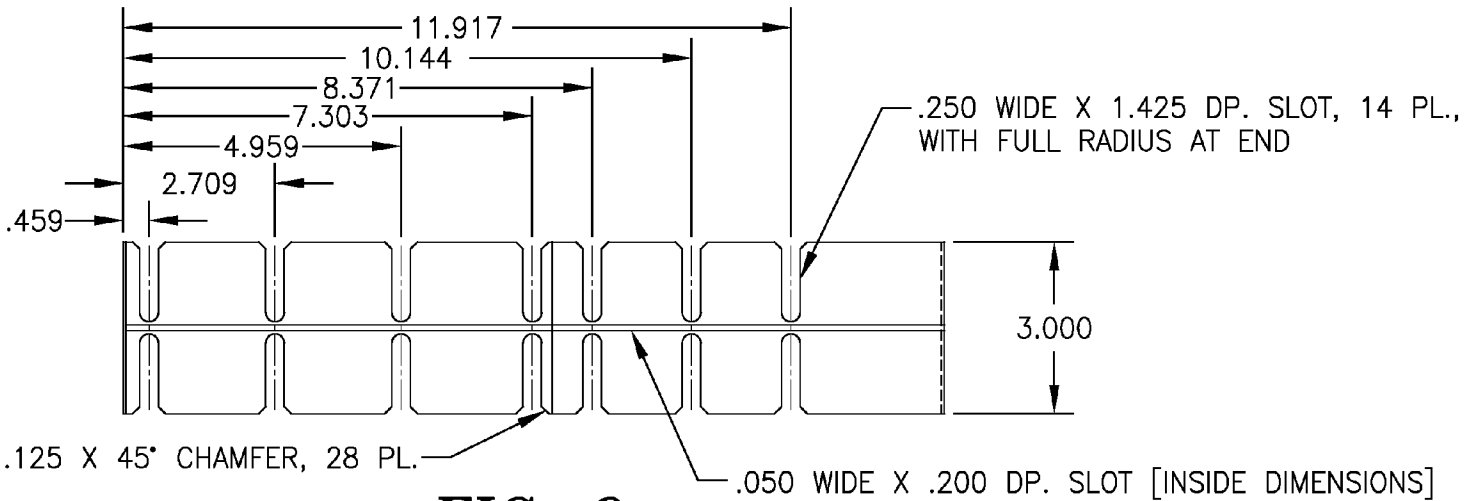
FIGS. 6*a*, 6*b*, and 6*c* are orthogonal views of one exemplary embodiment of a bridge component of the present invention (approximate dimensions are given for the purpose of example only).
Figure 6C:
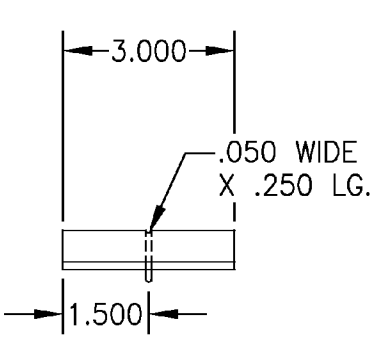
Figure 6B:
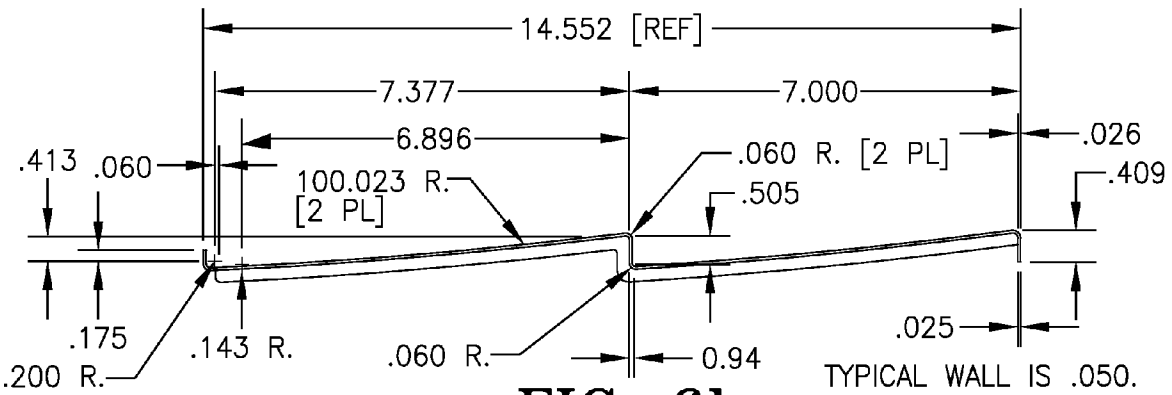

FIGS. 6*a*, 6*b*, and 6*c* illustrate one example of the present invention. The dimensions, which are in inches, are provided merely as an example of one embodiment of a bridge component of the present invention. Again, it should be recognized that such dimensions are provided for illustrative purposes only and are not intended to limit the invention, unless expressly claimed otherwise.

Such as shown in FIG. 7*a*, a relief channel or alternatively relief pockets 180 may be embodied within the backing panel 130 having space and suitable dimensions to accommodate tabs 30. In one exemplary embodiment, such relief channel(s) may be embodied upon the surface of the backing panel 130 that is adjacent to the interior surface of face panel 100. In particular, relief channel(s) 180 may be adapted to provide a gap or space between backing panel 130 and face panel 100 for receiving a side edge portion of a tab or plurality of tabs 30. It should be recognized that a relief channel(s) 180 of other exemplary embodiments might extend along a different portion or portions of the side edge portion or along the entire side edge portion of the backing panel 130. In addition, chamfers (not shown) having any suitable dimensions may be embodied on the exposed edges of said relief channel 180 to potentially help to limit damage to the side edge of the relief channel embodied within backing panel 130, which could be caused during the insertion of tab 30 into the relief channel. As a result, an exemplary embodiment of the present invention may enable the formation of an improved lap between adjacent backed paneling units.

More particularly, as just one example of a method of employing the present invention, either bridge component 10 or 70 may be installed between adjacent panels 150 as shown in FIGS. 7*a* and 7*b*. Installation may be achieved by inserting and optionally adhesively bonding tabs 30 of bridge component 10 or 70 within relief channel(s) 180 embodied between backing panel 130 and face panel 100 of a panel assembly 150, preferably insuring that alignment of either groove 40 or protuberant bead-line 70, respectively, coincides with a vertical joint 110 between adjacent panel assemblies. Such a configuration may be pre-assembled consistently on one side of panel assembly 150 making exposed and unbonded tabs 30 available for insertion and optionally bonding into receiving relief channel(s) 180 in an adjacent panel assembly 150 to align the panels and ultimately form a desired seal and appearance. Such a procedure may be accomplished at a factory location or at a construction site. Variant methods of employing exemplary embodiments of the present invention are possible. For instance, a plurality of bridge components 10 or 70 may alternatively be supplied separately along with panel assemblies 150 to allow a panel installer to install the components at a construction site. Other method variations and means of attachment are also possible.

As described herein, some exemplary embodiments of the present invention provide a system for connecting backed panels, wherein a bridge component may be used to align, level, and seal adjoining or otherwise adjacent siding panels. An exemplary bridge component may be adapted to interlock with mating features formed within a facing panel, a backing panel, or both. By providing mating surface features to receive a side edge portion of an adjacent backed panel, an exemplary embodiment of the present invention may enable an improved lap joint to be established between adjacent backed panels.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A bridge component for connecting adjacent panel assemblies, said bridge component comprising:

a web structure having an upper surface, a rear surface, a left side, and a right side;

said left side of said web structure comprised of a plurality of tabs extending substantially in a common plane along a length of said bridge component such that a slot is defined between adjacent tabs, said slot protruding inwardly from an outward edge of said left side;

said right side of said web structure comprised of a plurality of tabs extending substantially in a common plane along said length of said bridge component such that a slot is defined between adjacent tabs, said slot protruding inwardly from an outward edge of said right side;

a sealing feature on said upper surface comprised of a groove, said sealing feature extending along said length of said bridge component between said left side and said right side of said web structure; and at least one protuberant member on said rear surface, said at least one protuberant member extending along said length of said bridge component between said left side and said right side of said web structure;

wherein said bridge component is adapted to form a level, aligned, and sealed joint when installed between adjacent panel assemblies.

2. The bridge component of claim 1 wherein said bridge component is comprised of a plastic composite including cellulosic filler.

3. The bridge component of claim 1 wherein said bridge component is comprised of a metal.

4. The bridge component of claim 1 wherein said groove has a width of about 0.05 inch.

5. The bridge component of claim 1 wherein said left and right sides are substantially in a same common plane.

6. A bridge component for connecting adjacent panel assemblies, said bridge component comprising:

a web structure having an upper surface, a rear surface, a left side, and a right side;

said left side of said web structure comprised of a plurality of tabs extending substantially in a common plane along a length of said bridge component such that a slot is defined between adjacent tabs, said slot protruding inwardly from an outward edge of said left side;

said right side of said web structure comprised of a plurality of tabs extending substantially in a common plane along said length of said bridge component such that a slot is defined between adjacent tabs, said slot protruding inwardly from an outward edge of said right side;

a sealing feature on said upper surface comprised of a protuberant bead-line, said sealing feature extending along said length of said bridge component between said left side and said right side of said web structure; and at least one protuberant member on said rear surface, said at least one protuberant member extending along said length of said bride component between said left side and said right side of said web structure;

wherein said bridge component is adapted to form a level, aligned, and sealed joint when installed between adjacent panel assemblies.

7. The bridge component of claim 6 wherein said bridge component is comprised of a plastic composite including cellulosic filler.

8. The bridge component of claim 6 wherein said bridge component is comprised of a metal.

9. The bridge component of claim 6 wherein said protuberant bead-line has a width of about 0.05 inch.

10. The bridge component of claim 6 wherein said protuberant member has a width of about 0.05 inch.

11. The bridge component of claim 6 wherein said left and right sides are substantially in a same common plane.

* * * * *